US006361087B1

(12) United States Patent
Collet et al.

(10) Patent No.: US 6,361,087 B1
(45) Date of Patent: Mar. 26, 2002

(54) LOCKING FITTING FOR A DOOR, FRENCH WINDOW OR THE LIKE PROVIDED WITH A SPRING-BOLT ELASTICALLY RESTORED INTO LOCKING POSITION

(75) Inventors: Jean-Yves Collet, Saint-Jean-Saverne (FR); Gerard Prevot, *deceased*, late of Willerwald (FR), by Nadine Prevot, legal representative

(73) Assignee: Ferco International Ferrures et Serrures de Batiment SA, Sarrebourg (FR)

( * ) Notice: Subject to any disclaimer, the term of this patent is extended or adjusted under 35 U.S.C. 154(b) by 0 days.

(21) Appl. No.: 09/225,395

(22) Filed: Jan. 5, 1999

(30) Foreign Application Priority Data

Jan. 9, 1998 (FR) ..... 98 00284
Mar. 18, 1998 (FR) ..... 98 03504

(51) Int. Cl.[7] ..... E05C 1/06

(52) U.S. Cl. ..... 292/140; 292/DIG. 24; 292/169.13; 292/335

(58) Field of Search ..... 292/140, 153, 292/165, 169, 34, 37, DIG. 24, DIG. 26, 169.13, 169.19, 332, 335; 70/142, 157

(56) References Cited

U.S. PATENT DOCUMENTS 1,168,524 A * 1/1916 Lurie ..... 70/142
1,861,139 A * 5/1932 Samburg ..... 70/142
2,107,300 A * 2/1938 Kilpatrick ..... 70/142
2,114,084 A * 4/1938 Pearson ..... 70/142
2,241,872 A * 5/1941 Van Note ..... 292/335
2,649,324 A * 8/1953 Kanell ..... 70/142
2,723,873 A * 11/1955 Schlage ..... 292/153
3,175,376 A * 3/1965 Cantwell ..... 292/140
3,808,853 A * 5/1974 Helenurm ..... 70/411
3,912,309 A * 10/1975 Fischer et al. ..... 292/167
5,029,912 A * 7/1991 Gotanda ..... 292/143
5,452,928 A * 9/1995 Donald ..... 292/254
5,516,162 A * 5/1996 Takaishi ..... 292/37
5,524,941 A * 6/1996 Fleming ..... 292/34
5,529,351 A * 6/1996 Donald ..... 292/254
5,806,900 A * 9/1998 Bratcher et al. ..... 292/137

* cited by examiner

*Primary Examiner*—B. Dayoan
*Assistant Examiner*—John B. Walsh
(74) *Attorney, Agent, or Firm*—Harrison & Egbert

(57) ABSTRACT

A locking fitting for a leaf of a door, French window or the like, such as a lock, espagnolette-lock or the like, at least one spring-lock (2) elastically restored into locking position and capable of being actuated, through an appropriate control mechanism, such as by a control handle or knob.

This locking fitting includes a retainer associated to the spring-bolt and designed so as to be capable, on the one hand, of maintaining the latter in an unlocked or semi-locked position when the leaf is open and, on the other hand, of being made inactive in order to release the spring-lock by the sash-frame of the door or French window, in particular by a keeper this sash-frame is provided with and which is aimed at receiving the spring-bolt.

5 Claims, 2 Drawing Sheets

LOCKING FITTING FOR A DOOR, FRENCH WINDOW OR THE LIKE PROVIDED WITH A SPRING-BOLT ELASTICALLY RESTORED INTO LOCKING POSITION

BACKGROUND OF THE INVENTION (1) Field of the Invention

The invention relates to a locking fitting for a leaf of a door, French window or the like, such as a lock, espagnolette-lock or the like, comprising at least one spring-lock elastically restored into locking position and capable of being actuated, through an appropriate control mechanism, such as by a control handle or knob.

This invention will find its application in the field of the building iron-mongery and in particular relates to the locking fittings.

(2) Description of the Prior Art

Of course, a large number of locking fittings meeting the above description are known. Thus, a lock or an espagnolette-lock often includes, accommodated in a central casing, a control mechanism on which the user can act either by means of a control knob or handle or by means of a key-operated member, such as a barrel. Such a control mechanism in particular allows to act very frequently on a spring-lock elastically restored into locking position. In particular, this spring-lock is subjected to the action of a restoring spring which, when the action by the user is released, systematically pushes this spring-lock back into its locking position, so as to be capable of cooperating with a keeper. The head of such a spring-lock is therefore configurated, on one side, in the shape of a cam, so that the keeper the sash-frame is generally provided with can, when closing the leaf of the door or the like provided with such a lock or espagnolette-lock, ensure the moving back of this spring-lock against the action of the springy restoring means without it being necessary to act on any control handle or knob whatsoever. Of course, once this door is fully dosed, this spring-bolt positions itself in front of the corresponding hole in said keeper into which it engages, being pushed back by the aforementioned restoring spring.

Furthermore, there are already known means associated to locking fittings, the function of which is to maintain a locking organ in an unlocked position against the action of springy means for restoring into locking position, this at least as long as the leaf has not been closed against its sash-frame.

Such means are often found in espagnolettes or espagnolettes-locks including a control mechanism accommodated in a central casing and designed so as to be capable of actuating at least one operating rod and including, on the one hand, springy means for automatically restoring these operating rods into locking position as well as manual control means, in particular a tumbler actuated by a control handle, to ensure the unlocking of the operating rod and the resetting of the springy means. Such a control mechanism includes, on the other hand, a locking device capable of maintaining the operating rod in its unlocked position upon opening of the leaf of the door, French window or the like. This espagnolette or espagnolette-lock is of course provided with unlocking means capable of releasing the locking device when closing the leaf against the sash-frame and of enabling the restoring of the operating rod into locking position.

There is in particular known an espagnolette or espagnolette-lock provided with a locking device consisting of a locking pawl tiltingly fitted at the level of a face-plate which usually covers the various organs of the espagnolette or espagnolette-lock and which is located at the level of the front edge of the leaf. This locking pawl is caused to act in the direction of moving of this leaf, so that, when opening the latter, it automatically tilts towards the sash-frame, this under the action of a spring, whereas, when closing this leaf, the sash-frame is capable of pushing back this locking pawl against the spring.

Such a locking pawl is extended, at the level of its portion inside the casing containing the control mechanism, by a lever through which it is, capable of maintaining the operating rod or rods in their unlocked position, this when opening the leaf and, hence, as soon as this locking pawl could be released from the sash-frame.

Such a solution in fact has the drawback that the release mechanism is dissociated from a locking organ of the espagnolette or espagnolette-lock. This results into non-synchronous actions between the release mechanism and the locking organ.

In addition, it seems obvious that such a design makes the control mechanism of this espagnolette or espagnolette-lock more complex, in addition to the fact that the face-plate on which the locking pawl is tiltingly fitted corresponds to a specific embodiment which results into a more complicated control of manufacture and into an increase of the number of parts kept in stock.

SUMMARY OF THE INVENTION

Finally, by solving the problem of maintaining the spring-lock in unlocked or semi-locked position during the opening of a door, window or the like, this invention allows to contemplate, in a more advanced inventive step, associating to this spring-bolt the function of releasing not only its own springy restoring in locking position, but also the restoring in locking position of operating rods the moving of which is assisted by springy means.

To this end, the invention relates to a locking fitting for a leaf of a door, French window or the like, such as a lock, espagnolette-lock or the like, comprising at least one spring-lock elastically restored into locking position and capable of being actuated, through an appropriate control mechanism, such as by a control handle or knob, characterized in that it includes retaining means associated to the spring-bolt and designed so as to be capable, on the one hand, of maintaining the latter in an unlocked or semi-locked position when the leaf is open and, on the other hand, of being made inactive in order to release the spring-lock by the sash-frame of said door or French window, in particular by a keeper this sash-frame is provided with and which is aimed at receiving said spring-bolt.

Within the framework of a particular application of this invention, with the spring-bolt are associated at the level of its portion inside a casing receiving the mechanism for controlling the locking fitting, unlocking means in the shape of a control pawl capable of releasing a locking device designed so as to be capable of maintaining in an unlocked position another locking organ, such as an operating rod, automatically restored into locking position, this upon releasing the spring-lock by the retaining means when closing the leaf of the door or French window against its sash-frame.

One obviously understands that through this invention the various problems which have been evoked above are efficiently coped with.

BRIEF DESCRIPTION OF THE DRAWINGS

FIG. 3 is a schematic plan view of a spring blade associated to the spring-lock to restore into active position the retaining means the latter is provided with;

FIG. 4 is a schematic view of an espagnolette-lock which the object of this invention applies to;

DESCRIPTION OF THE PREFERRED EMBODIMENTS

Figure 4:
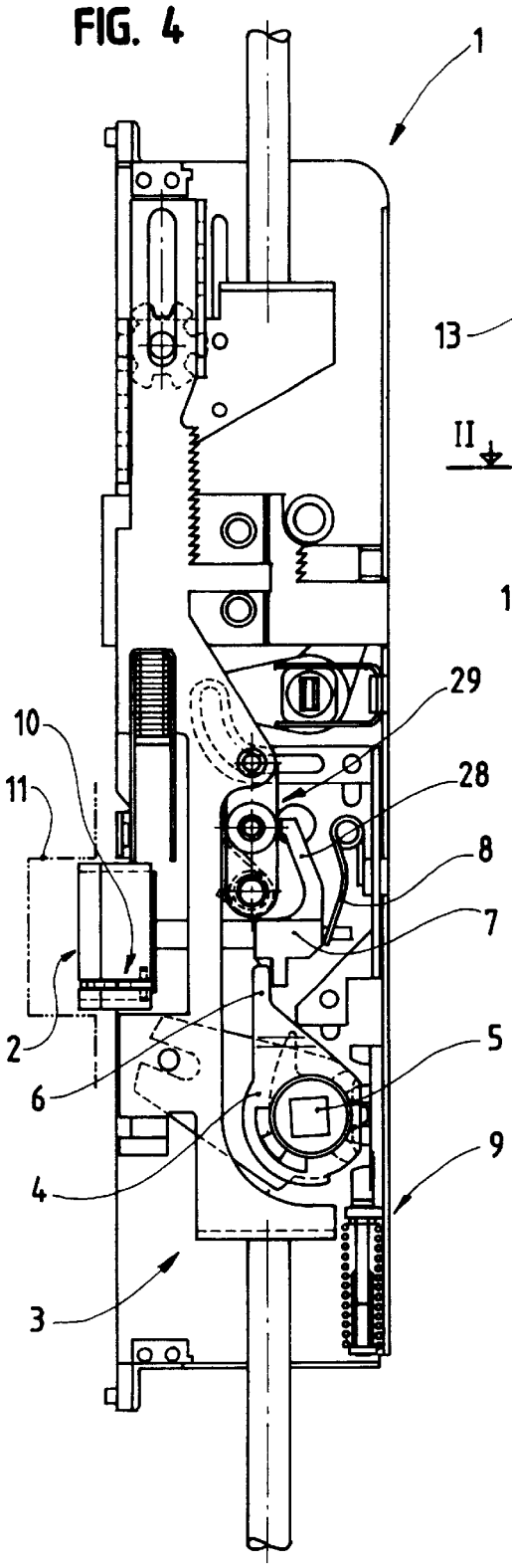
Figure 1:
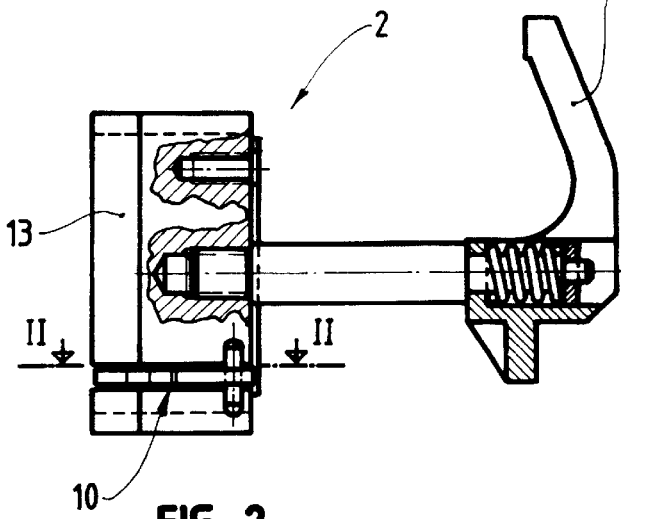
FIG. 1 is a schematic and partly cross-sectional view of a spring-bolt corresponding to a locking fitting and to which are associated retaining means according to the invention, this spring-bolt being here in addition provided with unlocking means capable of releasing a locking device acting on another locking organ, such as an operating rod, which is shown in FIG. 4 showing this invention in a particular application.
Figure 2:
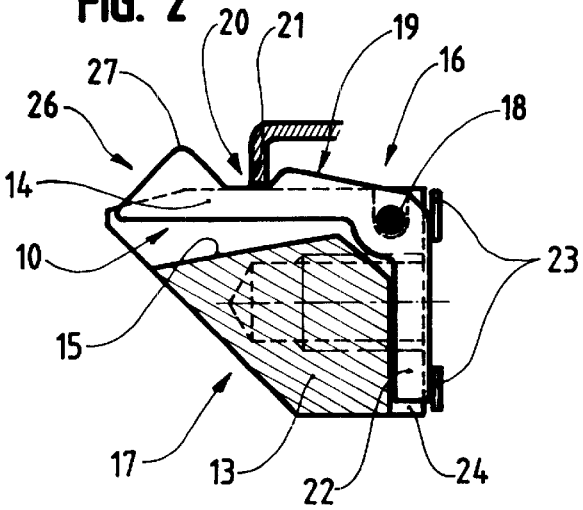
FIG. 2 is a schematic cross-sectional view according to II—II of FIG. 1.
Figure 5:
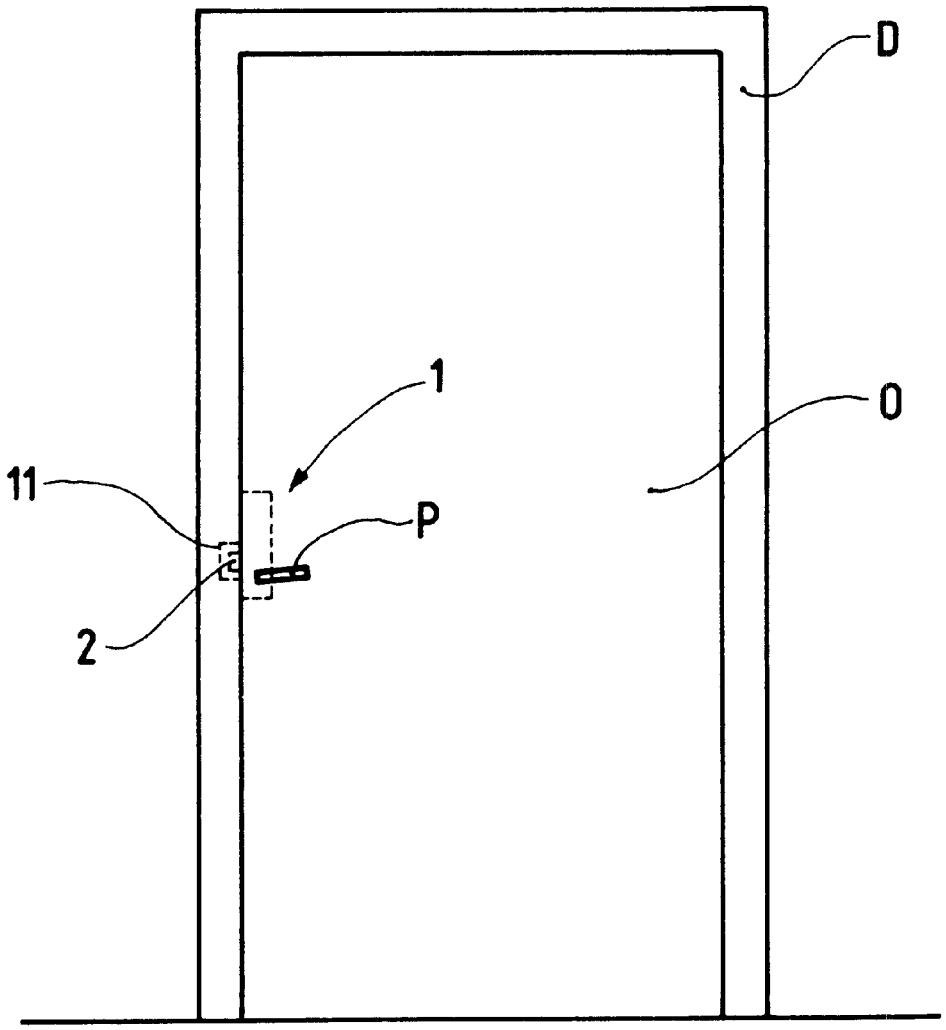
FIG. 5 is a schematic view of a door provided with a locking fitting according to the invention.

This invention relates to the locking fittings for a leaf of a door, French window or the like, such as a lock, espagnolette-lock or the like as can be seen in FIG. 5. Thus, this invention has been shown in FIG. 4 within the framework of its application to an espagnolette-lock corresponding to an example of embodiment, obviously taking into consideration that this invention is in no way limited to this example of embodiment.

As a matter of fact, a locking fitting 1 according to the invention includes at least one spring-bolt 2 elastically restored into locking position and capable of being actuated, through a control mechanism 3, by a control handle P or knob.

According to an example of embodiment, such a control mechanism 3 includes a tumbler 4 provided with a recess 5 for receiving a square for actuating the control handle. This tumbler 4 is, provided with at least one driving finger 6 capable of acting on the stem 7 of the spring-bolt 2 which is furthermore pushed back into its locking position under the action of a restoring spring 8.

In this respect, springy restoring means 9 can also act on the tumbler 4 to systematically restore the latter and, hence, the control handle, into a resting position, upon a control to unlock the spring-bolt 2.

According to the invention, this locking fitting 1 includes retaining means 10 associated to the spring-bolt 2 and designed so as to be capable, on the one hand, of maintaining the latter in an unlocked or semi-locked position when the leaf O provided with the locking fitting 1 is open and, on the other hand, of being made inactive in order to release the spring-lock 2 when dosing this leaf O, by the sash-frame D of the door or the like, in particular by the keeper 11 said spring-bolt 2. This keeper 11 has been schematically shown in broken lines in FIG. 4 of the attached drawing.

According to an advantageous embodiment, these retaining means 10 are automatically restored into active position under the action of a restoring spring 12. They are, furthermore, directly integrated into the head 13 of the spring-bolt 2 and are in the shape of a lever 14 accommodated in a groove 15 provided for at the level of the back face 16, opposite the bevelled one 17, of this head 13 of the spring-bolt 2. This groove 15 and, hence, the lever 14 extend parallelly to the direction of movement of this spring-bolt 2. This lever 14 is pivotingly fitted in this groove 15, about a vertical axis 18 perpendicular to the direction of movement of this spring-bolt 2.

In addition, at the level of the outer edge 19 of this lever 14 is provided for a cut-out 20 capable of co-operating, in the active position of these retaining means 10, with a retaining rim 21 which is usually defined by the slot, provided for either at the level of the casing receiving the control mechanism for the locking fitting 1 or at the level of the face-plate the latter includes, for the passing-through of the head 13 of the spring-bolt 2.

Figure 3:
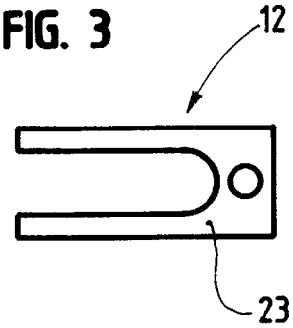

Finally, the lever 14 is extended, beyond its pivot axis 18, by a bend 22 on which acts the restoring spring 12 capable of systematically pushing the retaining means 10 back into the active position. This restoring spring 12 is preferably in the shape of a blade spring 23 secured to the rear of the head 13 of the spring-bolt 2. The shape of this blade spring 13 has been shown in FIG. 3.

As a matter of fact, one should observe that this bend 22 extending the lever 14 beyond its pivot axis 18 is also accommodated in a groove 24 which, in this case, extend at the rear of the head 13 of the spring-bolt 2. The bottom of this groove 24 acts as a stop against which the bend 22 is applied under the action of the blade spring 23 corresponding to the active position of the retaining means 10.

In addition, in order to allow these retaining means 10 to withdraw when the spring-bolt 2 moves back, the outer edge 19 of the lever 14, in front of the retaining rim 21, has a shape defined without set-back, in order to allow this action.

Finally, the lever 14 is also designed so as to be capable of co-operating with the sash-frame, in particular with the keeper 11 aimed at receiving the spring-bolt 2, this when closing the leaf corresponding to the door or the like, in order to release the spring-bolt 2. This lever 14 therefore includes, along its portion 26 remaining in all circumstances protruding with respect to the front edge of the casing (as the case may be, with respect to the face-plate), a control pawl 27 in the shape of a boss at the level of its outer edge 19.

As a matter of fact, this control pawl 27 is protruding with respect to the back face 16 of the head 13 of the spring-bolt 2 and is, accordingly, oriented towards the sash-frame of the door or the like.

Thus, the operation of such a fitting, starting from the locking position adopted when the door or the like is closed, includes if applicable upon unlocking of any key-operated member, in actuating, through a control handle, the tumbler 4 of the control mechanism 3, this in order to ensure the moving back of the spring-bolt 2, thus allowing the user to open the leaf.

At that moment, the user releases its action on the control handle, so that the spring-bolt 2 tends, under the action of the spring 8, to return to its locking position. Then act the retaining means 10 which, being maintained in the active position by the restoring spring 12, co-operate with the retaining rim 21, to retain the spring-bolt 2 in its unlocked or semi-locked position.

When closing the leaf against its sash-frame, the action of the keeper on the bevelled face 17 of the spring-bolt 2 causes, first of all, the moving back of the latter. Then, when this spring-bolt 2 is capable of penetrating into this keeper, the latter automatically actuates the control pawl 27 of the lever 14, so as to make the retaining means 10 inactive, allowing this spring-bolt 2 to reach its fully locked position.

One should observe that, within the framework of more complex locking fittings, e.g. an espagnolette-lock as shown in FIG. 4 and including, among other, means for automatically restoring operating rods into locking position, it is possible to imagine conferring to such a spring-bolt 2 provided with retaining means 10 a complementary function, i.e. that of ensuring the unlocking of the means 29 designed so as to be capable of maintaining the operating rods or any other locking organ in their unlocked position against the action of the springy restoring means, this during all the time the leaf is kept open.

Thus and by way of an example, the stem 7 of the spring-bolt 2 can receive a control pawl 28 substantially forming unlocking means capable of releasing said locking means 29 at the very moment of closing the leaf.

In addition, this invention corresponds to a compact solution associated at the level of a spring-bolt and capable of playing a control role as well as acting as a controller of the travel of this spring-bolt. By means of extrusion, a length larger than normal can also be conferred to the head 13 of this spring-bolt 2, so that it exhibits a higher resistance to burglary.

What is claimed is:

1. A locking fitting apparatus comprising:

a leaf;

a sash-frame receiving said leaf therein;

at least one spring lock connected to said leaf capable of moving between a locking position and a retracted position, said spring lock elastically urged toward said locking position said spring lock having a head, a retaining means being affixed to said head of said spring lock, said head having a back face and a beveled face, said back face having a groove therein, said groove extending parallel to a direction of movement of said spring lock;

a control means connected to said spring lock, said control means for actuating said spring lock;

the retaining means interactive with said spring lock, said retaining means said spring lock in said retracted position when said leaf is open, said retaining means releases said spring lock such that said spring lock is urged outwardly to said locking position when said leaf is closed in said sash-frame, said retaining means comprising:

a lever received within said groove, said lever pivotable about an axis perpendicular to said direction of movement, said lever having an outer edge with a cut-out formed thereon, said lever having a bent portion on a side of said lever opposite said cut-out;

a retaining rim cooperative with said cut-out of said outer edge of said lever; and a blade spring secured to a rear surface of said head, said blade spring cooperative with said bent portion so as to urge said bent portion toward said rear surface of said head, said head having a groove formed in said rear surface thereof, said bent portion received within said groove in said rear surface, said groove having an interior surface acting as a stop to a movement of said bent portion caused by said blade spring.

2. The apparatus of claim 1, said retaining means releases said spring lock through a keeper affixed in said sash-frame, said keeper receiving said spring lock in said locking position.

3. The apparatus of claim 1, said retaining rim comprising a slot through which said head of said spring lock passes, said slot formed on a casing of said control means.

4. The apparatus of claim 1, said retaining comprising a slot formed on a face plate through which said head passes.

5. The apparatus of claim 1, said control means comprising a casing having a front surface through which said spring lock protrudes when in said locking position, said lever having a portion extending outwardly beyond said front surface of said casing, said lever having a control pawl on said outer edge, said control pawl protruding outwardly away from said back face of said head, said control pawl cooperative with a keeper on said sash-frame, said keeper receiving said spring lock when said leaf is closed against said sash-frame.

* * * * *